United States Patent [19]

Miessen et al.

[11] 4,434,530

[45] Mar. 6, 1984

[54] PROCESS FOR THE PRODUCTION OF HIGHLY SHRINKABLE SPLIT TOWS OF ACRYLONITRILE POLYMERS

[75] Inventors: Ralf Miessen; Hans Wilsing; Fritz Schultze-Gebhardt, all of Dormagen, Fed. Rep. of Germany

[73] Assignee: Bayer Aktiengesellschaft, Leverkusen, Fed. Rep. of Germany

[21] Appl. No.: 241,199

[22] Filed: Mar. 5, 1981

[30] Foreign Application Priority Data

Mar. 15, 1980 [DE] Fed. Rep. of Germany ..... 3010045

[51] Int. Cl.[3] ..... D01G 1/08; D01F 6/18

[52] U.S. Cl. ..... 19/0.46; 28/246; 264/206

[58] Field of Search ..... 28/246; 19/0.35, 0.46; 264/206

[56] References Cited

U.S. PATENT DOCUMENTS

| | | | |
|---|---|---|---|
| 3,052,512 | 9/1962 | Kocay et al. | 28/246 X |
| 3,177,555 | 4/1965 | Clapp et al. | 28/246 X |
| 3,503,100 | 3/1970 | Glynn et al. | 28/246 X |
| 4,011,294 | 3/1977 | Davis | 264/206 |
| 4,035,884 | 7/1977 | Lohwasser et al. | 19/0.46 X |
| 4,071,596 | 1/1978 | Davis | 264/206 X |
| 4,140,844 | 2/1979 | Lohwasser | 264/206 X |

FOREIGN PATENT DOCUMENTS

| | | | |
|---|---|---|---|
| 2454322 | 5/1976 | Fed. Rep. of Germany | 264/206 |
| 2502195 | 7/1976 | Fed. Rep. of Germany | 264/206 |
| 2622920 | 12/1977 | Fed. Rep. of Germany | 264/206 |
| 2655172 | 6/1978 | Fed. Rep. of Germany | . |
| 53-65423 | 6/1978 | Japan | 264/206 |

*Primary Examiner*—Louis Rimrodt

*Attorney, Agent, or Firm*—Sprung, Horn, Kramer & Woods

[57] ABSTRACT

High-shrinkage stretch-broken tows of acrylonitrile polymers are obtained by fixing with saturated steam at maximum temperatures of 140° C. after drawing and before stretch breaking and stretch breaking at a draft of at least 30%.

10 Claims, No Drawings

PROCESS FOR THE PRODUCTION OF HIGHLY SHRINKABLE SPLIT TOWS OF ACRYLONITRILE POLYMERS

This invention relates to a process for the production of a split tow, of which the individual fibres have a boiling-induced shrinkage of at least 35%, by spinning in the usual way, followed by aftertreatment and stretch breaking. Yarns of individual fibres such as these are used in numerous fields, for example in the production of velour or imitation furs. The yarns are produced by spinning individual fibres which are normally obtained by cutting shrinkable slivers. One such process is described, for example, in German Offenlegungsschrift No. 2,655,172. To obtain shrinkability, it is necessary in this case to carry out drying carefully at temperatures below 60° C., which takes an undesirably long time.

It is known that the level of boiling-induced fibre shrinkage which it is possible to achieve depends upon the effective drawing level in the sense that shrinkage generally decreases with an increase in drawing. This gives rise to another disadvantage so far as high-shrinkage fibres are concerned, namely low strength attributable to the low degree of drawing.

It is desirable to use coloured yarns in various fields of article manufacture. It is not possible to dye the cut individual fibres or the yarns because in that case the shrinkage present would be released. Because of this, high-shrinkage fibres have to be dyed before they are given their shrinkability, i.e. normally in the spinning melt. For economical reasons, the batches to be dyed a given colour must not fall below a certain size.

Accordingly, an object of the present invention is to produce high-shrinkage fibres by a more economical drying process at higher temperatures, with greater strength in the shrunk yarn and with the possibility of dyeing smaller batches. It has now surprisingly been found that a tow which satisfies these requirements can be obtained by fixing with saturated steam after drawing and before the stretch breaking process.

Accordingly, the present invention provides a process for the production of high-shrinkage broken tows of acrylonitrile polymers by spinning, drawing and stretch breaking in the usual way, characterised in that fixing with saturated steam is carried out at a temperature not exceeding 140° C. after drawing and before stretch breaking and in that stretch breaking is carried out at a draft of at least 30%. The maximum steaming time is 30 minutes. The heating zone in which drafting takes place is preferably heated to between 120° and 160° C.

Normally, a draft of 65% is not exceeded in the heating zone and not less than 30%. Stretch breaking is advantageously carried out at a heating zone temperature of from 120° to 150° C. and at a draft of from 40 to 60% in the heating zone.

It is completely surprising that tows of the type in question can be dried at unusually high temperatures for high-shrinkage fibres of from 140° to 150° C. without any adverse effect upon the shrinkability of the broken tow. Under the effect of the high draft applied during stretch breaking, outstanding strength is imparted to the individual fibres and hence to the high-shrinkage yarns. It is readily possible by the process according to the invention to dye individual batches, however, small, by the methods normally used for dyeing tows. Shrinkage behaviour is unaffected by whether dyeing is carried out before or after steaming. This is a particular advantage of the process according to the invention.

Acrylonitrile polymers suitable for the purposes of the process according to the invention are polyacrylonitrile or, preferably, acrylonitrile copolymers containing at least 50% by weight of polymerised acrylonitrile. Copolymers such as these contain one or more monomers copolymerisable with acrylonitrile, such as acrylic acid esters, vinyl esters or monomers containing dye-receptive groups. It is preferred to use bundles of dry-spun filaments.

To extract the residual solvent, the filaments obtained after dry spinning are passed through aqueous baths in which they are drawn to between 2 and 6 times and preferably to between 2 and 3 times their original length. The maximum temperature of the aqueous baths is 100° C., the temperature preferably being in the range of from 65° to 75° C.

The drawn filaments are dried by air heated to between 140° and 150° C., as is normal for acrylic tows, after having been treated with a preparation necessary for further processing. In order to provide the individual filaments with adequate transverse adhesion, the bundle is passed through a stuffer box of the type normally used for crimping.

To ensure that the tow receives the required degree of shrinkage after stretch breaking, it is treated with saturated steam under pressure. The temperature prevailing during this treatment does not exceed 140° C., because damage can be caused at higher temperatures in the form of a deterioration in the natural colour of the tow and, if steaming is carried out for longer than 30 minutes, also in the form of a reduction in the fineness-related maximum tensile strength. On the other hand, a minimum temperature of 115° C. has to be maintained during fixing with saturated steam in order to obtain adequate boiling-induced shrinkage in the broken tow. The fact that the process steps of preparation, crimping, steaming and drying can be changed around is a particular advantage of the process according to the invention. It is left to the manufacturer to decide on whatever is the most suitable combination for his purposes. Thus, where a large autoclave is used, a sufficient amount of tow may be collected to carry out an economically optimal steaming process in such a way that, immediately afterwards, the tow may be delivered to the stretch break converter. Similarly, steaming may be continuously carried out in suitable apparatus immediately after drawing, followed in any order by preparation, crimping and drying.

To produce a coloured high-shrinkage broken tow, the tow may be dyed by any of the usual methods, such as pack dyeing or padding on the dye by means of a padding machine, the shrinkage behaviour of the broken tow being unaffected by whether the spun material is dyed or whether, for example, the tow is bale-dyed. However, dyeing is best carried out before the steaming operation because it is known that the dye is fixed by steaming.

The boiling-induced shrinkage which it is possible to obtain in the broken tow depends upon various parameters. It has been found that the degree of boiling-induced shrinkage is higher, the higher the comonomer content of the polymer, the lower the drawing ratio providing the comonomer content is less than 6% by weight, the higher the fixing temperature (saturated steam) and the higher the temperature and draft applied in the heating zone of the converter.

For certain articles, for example imitation furs, shrinkage power is an important factor in addition to the degree of shrinkage in the broken tow or shrinkage yarn because shrinkage has to be released against the resistance of the non-shrinking or substantially non-shrinking fibres. It has been found that copolymers having a comonomer content of from 6 to 10% by weight can be processed to form broken tows having a higher shrinkage power than broken tows of copolymers having a comonomer content of from 2 to 6% by weight.

By virtue of the described association between production parameters and shrinkage properties, it is possible by the process according to the invention to produce products having specific properties.

EXAMPLE 1

An acrylonitrile copolymer of 90.48% by weight of acrylonitrile, 9.0% by weight of methyl acrylate and 0.52% by weight of sodium methallyl sulphonate was dry-spun in the usual way. The spun tow, which had an overall strength of around 230 g/m, was washed in water at 85° C. and drawn in a ratio of 1:6.0 in two stages at a temperature of 95° C. in a combined washing and drawing machine. After an antistatic preparation had been applied, the tow was allowed to shrink by 29% in a tube filled with steam at 102° C. and was then dried under tension with air at 135° C. to a moisture content of 1.2% by weight. The tow was crimped in a stuffer box, into which steam was sprayed under a pressure of 1 bar, and was then deposited in a perforated can. After treatment with saturated steam at 120° C. in an autoclave, the tow was broken in the stretch breaking converter (Seydel type 671 S) at a heating plate temperature of 120° C. and at a draft of 58%. The individual fibres of the broken tow were tested with the following results:

| | |
|---|---|
| denier | 4.5 dtex |
| maximum tensile force | 21 cN/tex |
| maximum tensile force elongation | 41 ± 4% |

The fibres of the broken tow showed an average boiling-indued shrinkage of 30% and a maximum boiling-induced shrinkage of ~36%, whilst the yarn spun therefrom showed a boiling-induced shrinkage of 38.7% for a shrinkage force (air at 180° C.) of 5.9 mN/tex.

EXAMPLE 2

An acrylonitrile polymer having the same composition as in Example 1 was dry-spun in the usual way. The bundle of fibres still contained 16.4% by weight of the solvent which was washed out with water at elevated temperature in a combined washing and drawing process. The temperature in the washing baths was 85° C. and, in the drawing bath, was 95° C. The entry/exit speed quotient in the washing and drawing machine was 1:5.0. The drawn and washed tow was then treated with an antistatic preparation and subsequently steamed at 120° C. in a continuous pressure steamer (the Tunnel System of Messrs. Serracant of Spain), the residence time in the steamer being 9.5 minutes. The hot, moist tow was dried with hot air at 140° C. to a residual moisture content of 0.9% by weight, crimped and stretched by 50% at 160° C. before stretch breaking in the stretch breaking converter mentioned in Example 1. The broken tow obtained was spun into a yarn having a denier of 250 dtex. The yarn has a boiling-induced shrinkage of 43.4%. An elongation of 26.0% and a breaking force of 8.4 cN/text were measured during tensile testing of the fully shrunk yarn.

EXAMPLE 3

An acrylonitrile copolymer having the same composition as in Examples 1 and 2 was dry spun, washed in hot water at 85° C. to 95° C. and, at the same time, drawn to 6 times its original length. The wet tow treated with an antistatic preparation was crimped in a conventional stuffer box and, at the same time, mechanically dried to a residual moisture content of around 20% by weight. It was then dyed under elevated pressure (2.1 bars) in aqueous solution by the known "tow pack" process. After drying in the absence of tension at an air temperature of 140° C., the tow was processed into a broken tow. The heating plates had been heated to 120° C. and the draft amounted to 58%. The broken tow shrank by 41% and the yarn produced therefrom by 43.4%.

EXAMPLE 4

A dry-spun tow of an acrylonitrile copolymer of 93.6% by weight of acrylonitrile, 5.7% by weight of methyl acrylate and 0.7% by weight of sodium methallyl sulphonate is washed in water at 70° C. and drawn to 2.5 times its original length at the same temperature. The speed of the tow after the drawing process is 72 meters per minutes. Following the application of an antistatic preparation, the product is dried with air at a maximum temperature of 140° C., the exit speed from the dryer being 25% lower than the speed of entry. Before splitting at a heating plate temperature of 140° C. and at a draft of 44%, the 6.84 km long tow deposited in a perforated can is treated with saturated steam at 125° C. in an autoclave. In this treatment, the tow is subjected to 5 steaming phases each lasting 2 minutes and to 7 evacuation phases each lasting 2 minutes in order to guarantee uniform heating of the individual fibres. The individual fibres of the broken tow have a boiling-induced shrinkage of from 32 to 39%, the maximum of the distribution curve lying at 36%. After a yarn (250 dtex) has been spun from this broken tow, a boiling-induced yarn shrinkage of 43% is measured.

We claim:

1. An improved process for the production of high-shrinkage stretch-broken tows of acrylonitrile polymers by spinning, drawing and stretch breaking in the usual way, comprising fixing with saturated steam at maximum temperature of 140° C. after drawing and before stretch breaking and stretch breaking at a draft of at least 30% whereby the resultant stretch broken yarn has a shrinkage of at least 30%.

2. A process as claimed in claim 1, comprising that at least 50% of the acrylonitrile polymers consist of acrylonitrile.

3. A process as claimed in claim 1, comprising processing bundles of dry-spun filaments.

4. A process as claimed in claim 1, comprising drawing the bundle of filaments in ratio of from 1:2.0 to 1:6.0.

5. A process as claimed in claim 1, comrising drawing the bundle of filaments in a ratio of from 1:2.0 to 1:3.0 at temperatures in the range of from 65° C. to 75° C.

6. A process as claimed in claim 1, comprising fixing the drawn tows with saturated steam at 115° to 140° C.

7. A process as claimed in claim 1, comprising drafting at a heating zone temperature of from 120° to 160° C.

8. A process as claimed in claim 1, comprising stretch breaking with a draft in the first stretching zone of not less than 30%.

9. A process as claimed in claim 1, comprising stretch breaking at a heating zone temperature of from 120° to 150° C. and at a draft of from 40 to 60%.

10. A process as claimed in claim 1, comprising steaming for nor more than 30 minutes.

* * * * *